US009199114B1

(12) United States Patent
Santoro

(10) Patent No.: US 9,199,114 B1
(45) Date of Patent: Dec. 1, 2015

(54) HARNESS WITH UPPER BODY EXERCISER

(71) Applicant: Vincent Santoro, Massapequa, NY (US)

(72) Inventor: Vincent Santoro, Massapequa, NY (US)

( * ) Notice: Subject to any disclaimer, the term of this patent is extended or adjusted under 35 U.S.C. 154(b) by 128 days.

(21) Appl. No.: 14/089,541

(22) Filed: Nov. 25, 2013

(51) Int. Cl.

| | |
|---|---|
| ***A63B 21/015*** | (2006.01) |
| ***A63B 22/12*** | (2006.01) |
| ***A63B 22/00*** | (2006.01) |
| *A63B 21/00* | (2006.01) |

(52) U.S. Cl.
CPC ..... *A63B 21/015* (2013.01); *A63B 22/0002* (2013.01); *A63B 21/1411* (2013.01)

(58) Field of Classification Search
CPC ..... A63B 21/1449; A63B 21/1434; A63B 2220/54; A63B 21/1411; A63B 21/015; A63B 21/1484; A63B 21/1469; A63B 21/0442; A63B 2022/06; A63B 2022/0605; A63B 2022/0611; A63B 2022/0623; A63B 2022/00629; A63B 2022/0635; A63B 2022/0641; A63B 21/1403; A63B 21/1407; A63B 21/1415; A63B 21/1476; A63B 22/00; A63B 22/0002; A63B 22/0007; A63B 22/0012; A63B 22/0605; A63B 23/00; A63B 23/1245; A63B 23/1254; A63B 23/1263; A63B 23/1272; A63B 2022/0617
USPC ..... 482/51, 57–66, 92, 114–119, 139, 148, 482/904; 224/265; 74/523
See application file for complete search history.

(56) References Cited

U.S. PATENT DOCUMENTS

| | | | | |
|---|---|---|---|---|
| 1,402,179 | A | | 1/1922 | Piscitelli |
| 1,432,013 | A | | 10/1922 | Blake |
| 1,618,273 | A | | 2/1927 | Davidson |
| 2,097,376 | A | | 10/1937 | Marshman |
| 2,190,895 | A | * | 2/1940 | Turpin ..... 482/63 |
| 2,668,709 | A | | 2/1954 | Boyko |
| 2,817,524 | A | | 12/1957 | Sadler |
| 2,854,880 | A | * | 10/1958 | Waters ..... 84/421 |
| 3,224,765 | A | * | 12/1965 | Baker et al. ..... 482/60 |
| 3,227,447 | A | * | 1/1966 | Baker et al. ..... 482/60 |
| 3,309,084 | A | | 3/1967 | Simmons |
| 3,662,747 | A | * | 5/1972 | Williams ..... 601/5 |
| 4,060,241 | A | | 11/1977 | Hegel |
| 4,225,130 | A | * | 9/1980 | Zimmerman ..... 482/60 |
| 4,387,839 | A | * | 6/1983 | Dranchak ..... 224/265 |
| 4,717,146 | A | | 1/1988 | Nohara |
| 4,722,522 | A | | 2/1988 | Lundgren |
| 4,925,184 | A | * | 5/1990 | McJunkin et al. ..... 482/60 |
| 4,961,573 | A | | 10/1990 | Wehrell |
| 4,973,046 | A | * | 11/1990 | Maxwell ..... 482/60 |
| 4,986,537 | A | | 1/1991 | D'Orta |
| 5,005,829 | A | * | 4/1991 | Caruso ..... 482/112 |
| 5,042,799 | A | * | 8/1991 | Stanley ..... 482/123 |
| 5,108,092 | A | * | 4/1992 | Hurst ..... 482/60 |
| 5,137,272 | A | | 8/1992 | Wilkinson |
| 5,141,223 | A | | 8/1992 | Block |
| 5,176,377 | A | | 1/1993 | Wilkinson |
| 5,178,593 | A | | 1/1993 | Roberts |

(Continued)

*Primary Examiner* — Oren Ginsberg
*Assistant Examiner* — Andrew S Lo
(74) *Attorney, Agent, or Firm* — Alfred M. Walker

(57) ABSTRACT

An upper body exerciser which is compatible with walking or using a treadmill permits vigorous upper body exercise involving hands, arms, biceps, triceps, shoulders, and neck. The upper body exerciser is a harness that rests on the shoulders of a person with a forward extension presenting handgrips at the distal ends of a hand crank that can be rotated such as bicycle pedals are rotated by the feet. Since the harness is easily donned or removed with just a single motion without the need for confining straps, its convenience encourages frequent use.

21 Claims, 6 Drawing Sheets

(56) References Cited

U.S. PATENT DOCUMENTS

| | | | | | |
|---|---|---|---|---|---|
| 5,234,395 | A | | 8/1993 | Miller et al. | |
| 5,312,312 | A | * | 5/1994 | Fernandez et al. | 482/60 |
| 5,328,432 | A | | 7/1994 | Gvoich | |
| 5,462,508 | A | * | 10/1995 | Schiavone | 482/122 |
| 5,573,158 | A | * | 11/1996 | Penn | 224/265 |
| 5,580,338 | A | | 12/1996 | Scelta et al. | |
| 5,618,247 | A | * | 4/1997 | Perez | 482/60 |
| 5,647,822 | A | * | 7/1997 | Avganim | 482/60 |
| 5,720,702 | A | * | 2/1998 | Lee | 482/129 |
| 5,800,323 | A | * | 9/1998 | Ansel | 482/129 |
| 5,846,169 | A | * | 12/1998 | Tscheschlog | 482/105 |
| 5,860,941 | A | * | 1/1999 | Saringer et al. | 601/33 |
| 5,902,218 | A | * | 5/1999 | Froelich, Sr. | 482/118 |
| 5,916,070 | A | | 6/1999 | Donohue | |
| 6,547,701 | B1 | * | 4/2003 | Eschenbach | 482/57 |
| 6,659,921 | B2 | | 12/2003 | Vernon | |
| 6,764,231 | B1 | * | 7/2004 | Shubert | 396/419 |
| 6,905,447 | B1 | * | 6/2005 | Walter | 482/121 |
| 7,303,513 | B1 | * | 12/2007 | Curtiss | 482/130 |
| 7,445,584 | B2 | | 11/2008 | Wu | |
| 7,470,221 | B1 | * | 12/2008 | Ramos | 482/100 |
| 7,530,932 | B2 | * | 5/2009 | Lofgren et al. | 482/62 |
| 7,695,410 | B2 | * | 4/2010 | Kim | 482/57 |
| 7,727,125 | B2 | | 6/2010 | Day | |
| 7,740,572 | B2 | * | 6/2010 | Verheem | 482/142 |
| 7,837,599 | B2 | * | 11/2010 | Kowalczewski et al. | 482/44 |
| 7,942,793 | B2 | | 5/2011 | Mills et al. | |
| 7,988,601 | B2 | * | 8/2011 | Bowser | 482/57 |
| 2003/0092536 | A1 | * | 5/2003 | Romanelli et al. | 482/60 |
| 2004/0157708 | A1 | * | 8/2004 | Matthews | 482/57 |
| 2004/0198563 | A1 | * | 10/2004 | Howell et al. | 482/62 |
| 2005/0014614 | A1 | * | 1/2005 | Ahman | 482/105 |
| 2005/0040193 | A1 | * | 2/2005 | May | 224/201 |
| 2006/0186151 | A1 | * | 8/2006 | May | 224/265 |
| 2007/0066460 | A1 | * | 3/2007 | Torres | 482/124 |
| 2008/0124991 | A1 | * | 5/2008 | Kolarick et al. | 441/129 |
| 2008/0182735 | A1 | * | 7/2008 | Thomas | 482/139 |
| 2008/0261786 | A1 | * | 10/2008 | Laramore | 482/124 |
| 2010/0292051 | A1 | * | 11/2010 | Benumof et al. | 482/10 |
| 2012/0077647 | A1 | * | 3/2012 | Zuckerman | 482/110 |
| 2013/0079200 | A1 | * | 3/2013 | Rahimi | 482/62 |
| 2013/0143723 | A1 | * | 6/2013 | Bender | 482/121 |

* cited by examiner

Fig. 1
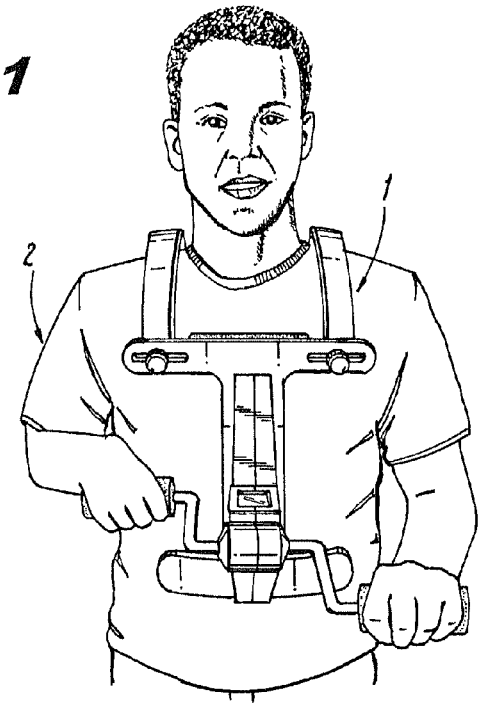
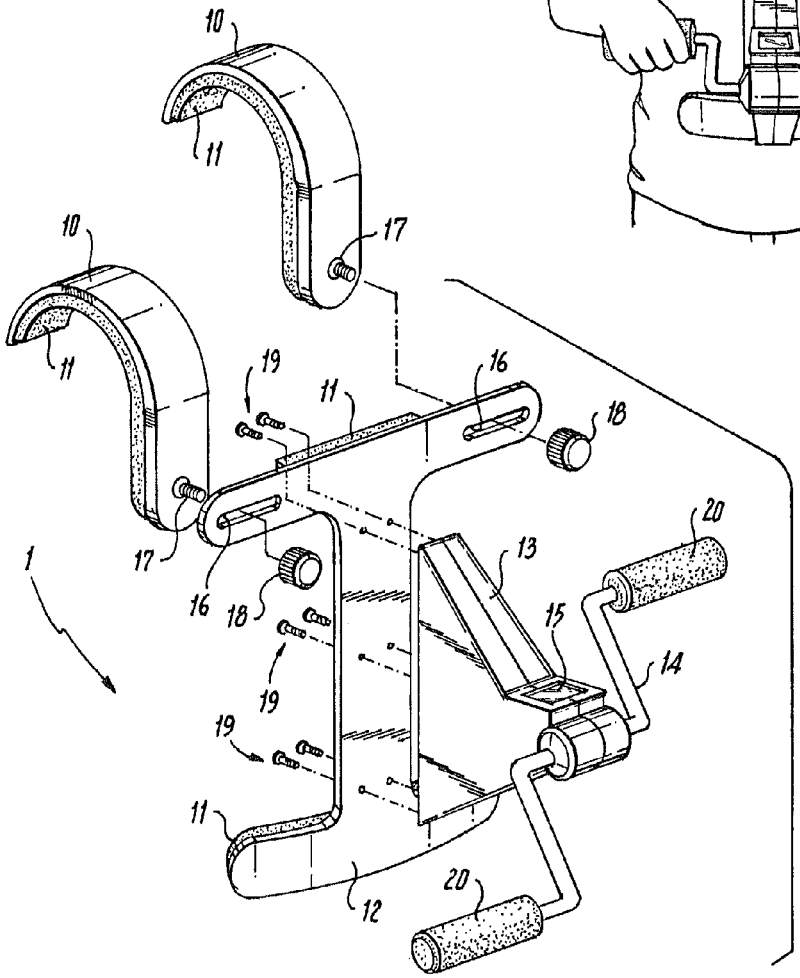
Fig. 2

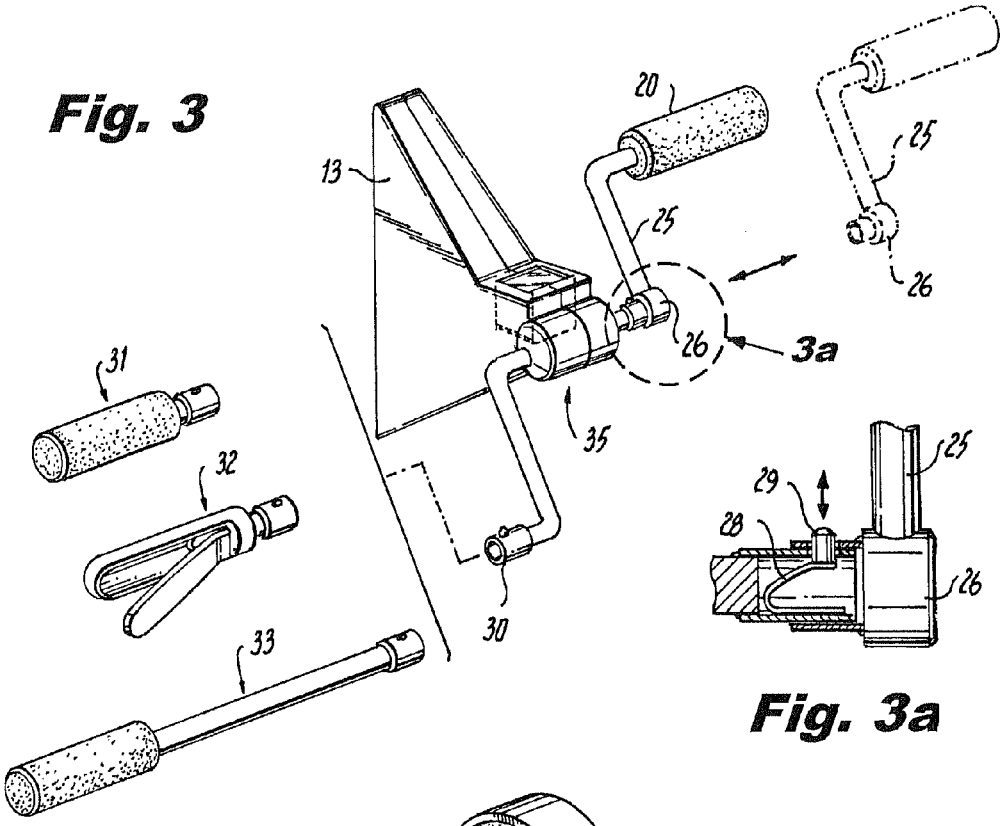
Fig. 3
Fig. 3a
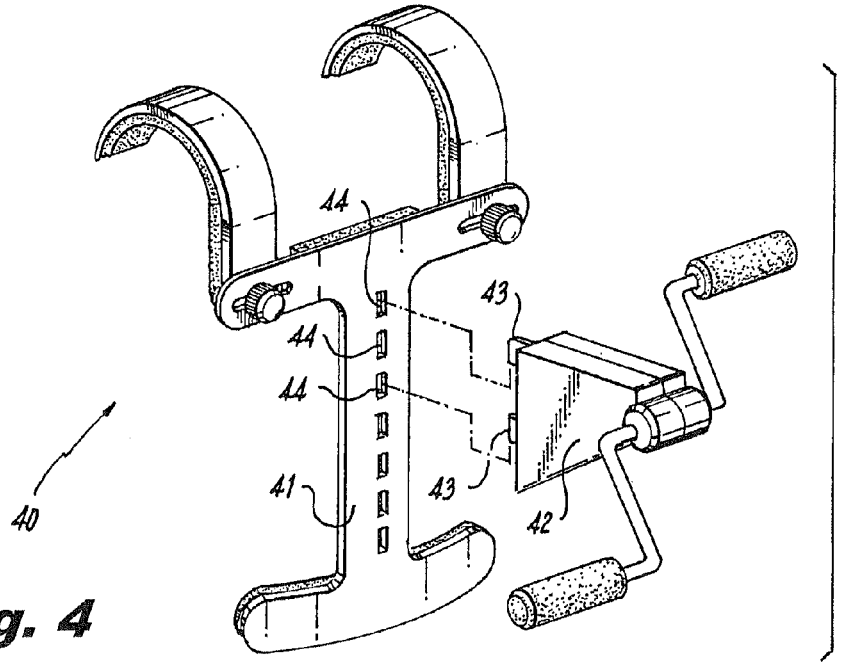
Fig. 4

Fig. 9
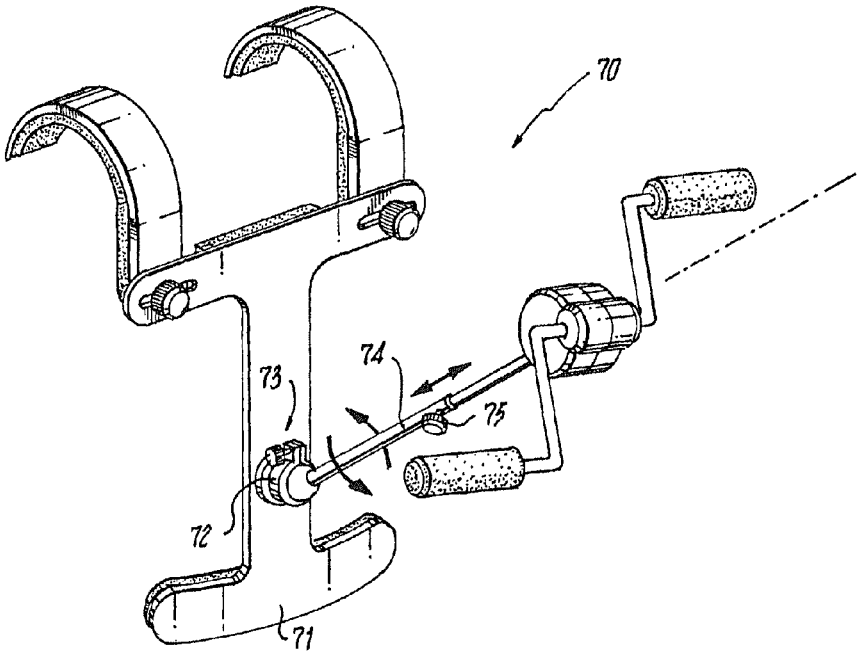
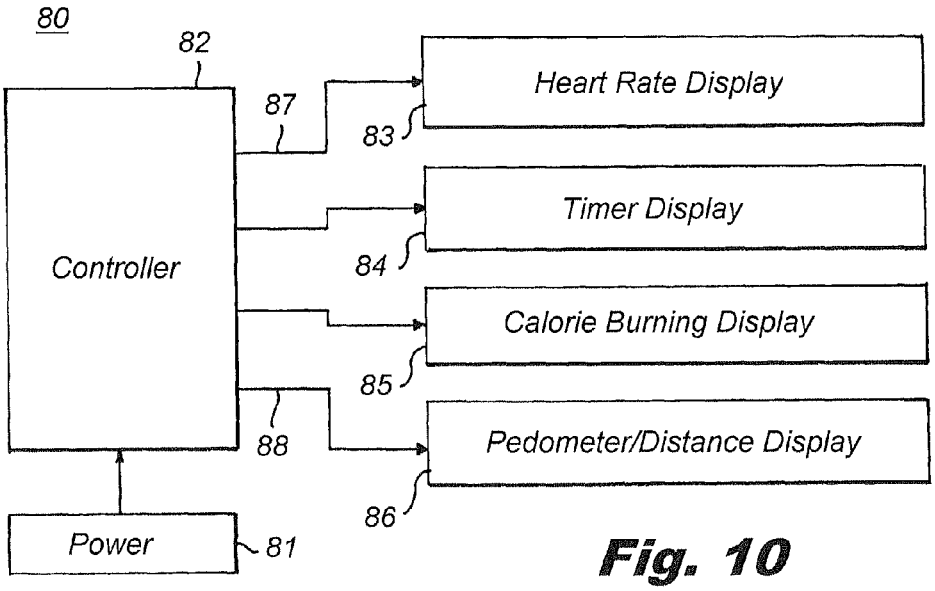
Fig. 10

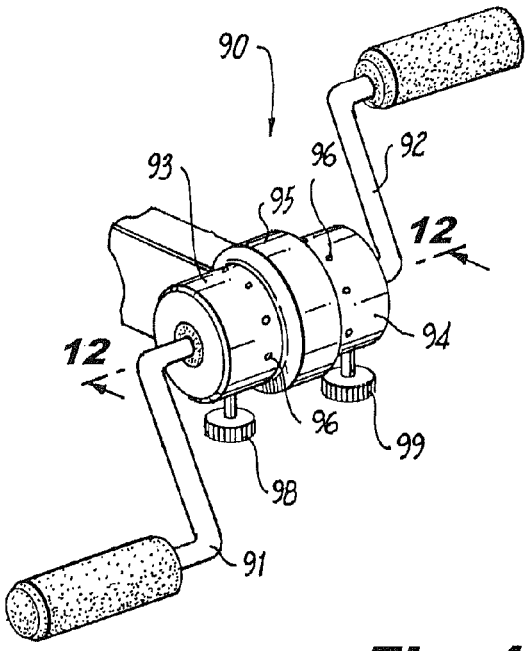
Fig. 11
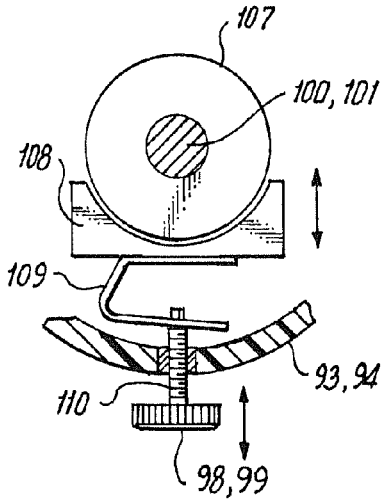
Fig. 13
Fig. 12
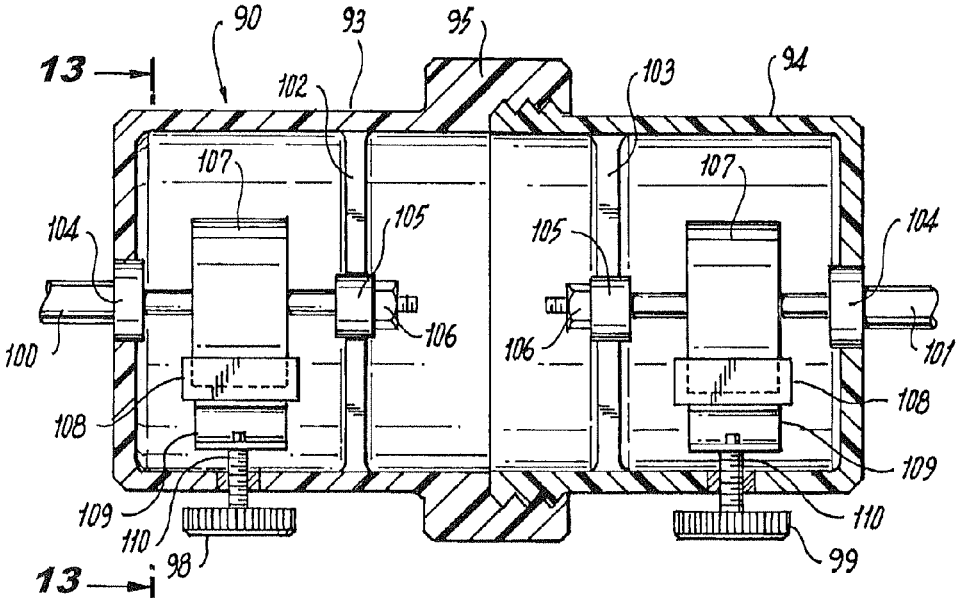

HARNESS WITH UPPER BODY EXERCISER

FIELD OF THE INVENTION

This invention is concerned with an upper body exercise harness that can be worn and used by a person while performing lower body exercise such as walking or using a treadmill.

BACKGROUND OF THE INVENTION

Non-portable arm exercise machines are disclosed in U.S. Pat. No. 2,668,709 of Boyko for a chair mounted arm exerciser, U.S. Pat. No. 4,060,241 of Hegel for a wall mounted arm exerciser, U.S. Pat. No. 3,309,084 of Simmons, also for a wall mounted arm exerciser and U.S. Pat. No. 5,580,338 of Scelta. Scelta '338 discloses a non-walking lap supported arm bike exerciser.

Portable body worn arm exercisers are disclosed in U.S. Pat. No. 5,141,223 of Block for a limb exercise harness with elastic band/cords, U.S. Pat. No. 5,328,432 of Gvoich for a belt worn arm stretch exerciser with elastic band/cords, U.S. Pat. No. 1,402,179 of Piscitelli for an arm exercise harness with elastic band/cords, U.S. Pat. No. 1,432,013 of Blake for an arm exerciser with elastic band/cords, U.S. Pat. No. 1,618,273 of Davidson for a belt and harness worn arm exerciser with elastic band/cords, U.S. Pat. No. 2,097,376 of Marshman for an exercise harness with elastic band/cords, U.S. Pat. No. 4,961,573 of Wehrell for a boxing exercise harness with elastic band/cords, and U.S. Pat. No. 5,176,377 of Wilkinson for a limb exercise harness with elastic or non-elastic band/cords.

However the elastic arm exercises with harnesses and elastic bands/cords may be dangerous if the elastic pull cords slip out of the user's hands and fly toward someone else (or the user). Also, rotatable pedals may be better exercise for the shoulders and neck, which might get strained from too much elastic pull, since the force exerted by elastic band/cords gets harder as it stretches, but the force is constant during pedaling.

U.S. Pat. No. 4,986,537 of D'Orta describes a hip-worn sidewinder exerciser with rotational crank handles which are turned by the arms at the side of the wearer. However, D'Orta does not allow the wearer to exercise the arms in front of the wearer.

U.S. Pat. No. 5,234,395 of Miller and U.S. Pat. No. 5,916,070 of Donohue both disclose arm exercisers each with an inelastic cord which is alternately pulled forward by the left and right arms in a reciprocating matter. U.S. Pat. No. 6,659,921 of Vernon describes an arm exercise harness with a resilient, stretchable or elastic cord set which is pulled by the arms of the wearer.

It is known to simulate physical activity on an exercise machine by increasing or decreasing resistance. Resistance is a "torque" quantity in units of "length times force" such as inch-pounds or foot-pounds. Watts is a power term like horsepower: power=torque times rotational speed. One relationship is torque in inch pounds=(HORSEPOWER×63,025)/RPM. Another relation is 1 Watt=44.2537 foot-pounds/minute. A kilogram calorie (physiological type) is a unit of heat or energy akin to a Watt-second. For example, 1 kg calorie=1.162 watt-hours and is derived by integrating Watts over time.

To calibrate or manipulate "resistance" in terms of Watts, one must know both the torque and the speed simultaneously. So a unit that sets "resistance" to expend energy at a certain rate of power in Watts, one determines a measure of the torque and a measure of rotational speed (such as RPM) which is usually derived from a speed sensor such as a digital encoder (or a conventional tachometer).

U.S. Pat. No. 7,727,125 of Day describes a foot pedal exercise device with a servo controller controlling brake resistance to simulate harder exercise. The method used in Day '125 or similar stationary powered exercise gym machine in a gym or rehab venue with utility supplied electric power may not be feasible for a portable walk-around unit because of power limitations. For example, if a brake drum and pad are forced together directly by an electromagnetic linear actuator, it would be too power-hungry. However, a motor and lead screw works well just using a small battery for a portable unit.

OBJECTS OF THE INVENTION

It is therefore an object of the present invention to provide a an upper body exercise harness that can be worn and used by a person while performing lower body exercise such as walking or using a treadmill.

It is also an object of the present invention to provide an arm exerciser which can be used in front of the chest of the user while walking or using a treadmill, which utilizes rotational pedals and which promotes the well being of the user.

It is yet another object of the present invention to provide a smooth exercise force which 1.0 can be optionally adjusted in the amount of force exerted.

It is yet another object of the present invention to provide an easily worn exercise device which encourages the user to exercise without complicated assembly.

Other objects which become apparent from the following description of the present invention.

SUMMARY OF THE INVENTION

While the prior art does address some limited types of upper body exercise that is compatible with walking or using a treadmill, this invention permits vigorous upper body exercise involving hands, arms, biceps, triceps, shoulders, and neck. The present invention is a harness that rests on the shoulders of a person with a forward extension presenting handgrips at the distal ends of a hand crank that can be rotated such as bicycle pedals are rotated by the feet. Since the harness is easily donned or removed with just a single motion without the need for confining straps, its convenience encourages frequent use.

In the first most basic embodiment, the present invention comprises two arcuate harness loops that fit over the shoulders, a chassis plate that connects the two harness loops at the top to a lower horizontal section that rests against the waist region, and a forward extension attached to the central vertical portion of the chassis plate. The forward extension carries bearings that locate the hand crank mechanism. All body contact areas of the invention are padded with a layer of resilient foam for comfort. The forward extension also houses an electronic monitor of biological metrics and time/distance with a display visible at the top.

In the second embodiment of the present invention, two features are added. The cranks are removable from the shaft so that by the use of two spring latches either one or both can be used. This is of advantage if the person using the upper body exerciser has had an injury to one arm or hand or is indeed an amputee. A freely rotating hand grip may be distracting. Another feature is that the hand grip itself may be removed from the crank or exchanged using spring latches at the distal ends of the crank. A variety of hand grips may be engaged, such as a basic hand grip, a hand-exercising spring hand grip, or a hand grip at the end of a longer shaft to more efficiently exercise shoulder muscles.

In the third embodiment of the invention, the vertical center section of the chassis plate is perforated at set intervals to permit a vertical adjustment of the forward extension which has two downward opening hooks facing back which are in registration with the perforations. The desired height is selected by choosing the appropriate pair of perforations to mate with the hooks.

In a fourth embodiment a bar with a series of holes is engaged forward of the chassis plate. The forward extension is modified to engage the bar and lock into a pair of holes on the bar at a desired location forward of the chassis plate offering variable forward placement for the crank set. The bar itself has three selectable positions of engagement with the chassis plate so that the crank set can be located grossly in the vertical direction and more finely in the horizontal direction.

In a fifth embodiment, an L-shaped bar is engageable with the chassis plate at three vertical positions (as in the fourth embodiment). The L-shaped bar with one side horizontal and one vertical (pointing upwards) has a series of holes along both legs. The forward extension as modified for the fourth embodiment can be engaged with any pair of adjacent holes on either the horizontal or vertical legs of the L-shaped bar affording great positional variability of the crank set in small increments.

In the sixth embodiment, a ball joint with lock clamp is attached to the vertical central section of the chassis plate. Attached to the ball of the ball joint is a telescoping rod with adjustment lock carrying the crank set at its distal end. This arrangement permits great continuous variability in location of the crank set.

A seventh embodiment of the present invention is a crank set with separate crank shafts permitting any circumferential relationship in the relative positions of each crank. In fact, one crank can be rotated clockwise while the other is rotated counterclockwise. The more important feature that this flexibility permits is the addition of two separate rotational friction adjustments, one for each crank side or hand grip. This is an important feature especially for upper body exercise in rehabilitation from injury to one side or the other, or to compensate for atrophy or weakness in one side or the other. Inside the central housing of the crank set are two separate brake drums and friction pads with external adjusting knobs to permit separate friction adjustments for each side.

BRIEF DESCRIPTION OF THE DRAWINGS

The present invention can best be understood in connection with the accompanying drawings. It is noted that the invention is not limited to the precise embodiments shown in drawings, in which:

FIG. 1 is a perspective view of the harness with upper body exerciser of this invention in use by a person.

FIG. 2 is a perspective exploded view of the parts comprising the harness of FIG. 1.

FIG. 3 is an exploded view of the parts of the crank set of the second embodiment of this invention showing a detachable crank as well as three variations of detachable hand grips.

FIG. 3*a* is a side elevation detail in partial cross section of the spring detachment latch mechanism used in FIG. 3.

FIG. 4 is a perspective exploded view of third embodiment of this invention showing a vertically adjustable attachment of the crank set relative to the harness chassis.

FIG. 9 is a perspective view of the sixth embodiment of this invention using a ball joint and telescoping rod to be able to locate the crank set rapidly and smoothly in a desired space in front of the harness chassis.

FIG. 10 is a high level block diagram of an electronic monitoring system of this invention.

FIG. 11 is perspective view of the seventh embodiment of this invention comprising a crank set affording separate adjustment of frictional resistance for each side.

FIG. 12 is a side view in partial cross section showing the internal parts comprising the features of the seventh embodiment of this invention.

FIG. 13 is an end view of a brake drum, friction pad, leaf spring, friction screw, and knob all used in the seventh embodiment.

DETAILED DESCRIPTION OF THE INVENTION

Figure 5:
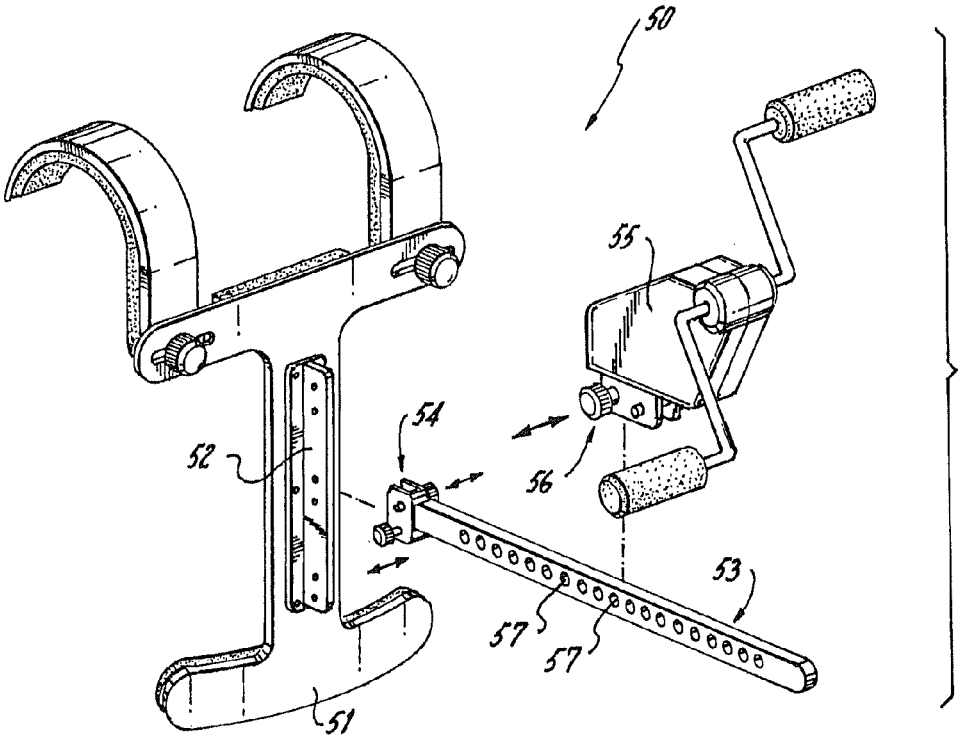
FIG. 5 is a perspective exploded view of the fourth embodiment of this invention using a bar with a series of holes to permit more horizontal adjustment of the crank set.

The present invention is described below in optional alternate embodiments, which can be varied. For illustrative purposes only, preferred modes for carrying out the invention are described herein.

FIGS. 1 and 2 relate to the first embodiment 1 of the harness with upper body exerciser of this invention; a person 2 using harness 1 is shown in FIG. 1. FIG. 2 is an exploded view of harness 1 with harness chassis plate 12 with harness loop attachment slots 16 at the top horizontal section, a middle vertical section below and a lower end horizontal section that rests approximately at waist level on the user. Harness loops 10 have attached studs 17 which engage attachment/adjustment knobs 18 through slots 16. Forward section 13 is a member which locates crank set 14 and attaches to harness chassis plate 12 via six screws 19. Hand grips 20 are at the distal ends of crank set 14. Note that all surfaces which touch the user preferably have an attached cushioned layer, such as, for example, of resilient foam 11. Display 15 of an electronic so monitoring and information module is visible at the top of forward section 13.

FIG. 3 shows the parts involved with the optional detachable crank and hand grips of the second embodiment which are incorporated into modified crank set 35. These modifications are quick disconnect latches 26 which can detach a crank 25 from the shaft and 30 which is used to make the hand grips 20 removable. Three different types of detachable hand grips are shown, 31 is a normal hand grip, 32 is a hand exercising grip which is squeezed repeatedly, 33 is a normal hand grip attached to a wider shaft to spread the grips apart horizontally. It can be wider lengthwise by having a longer shaft, or it can be telescopically wider. FIG. 3*a* is a detail showing the internal leaf spring 28 and engagement button 29 of latch 26. A similar mechanism is used in latches 30 for the hand grips.

FIG. 4 shows the third embodiment 40 of harness showing harness chassis plate 41 a vertical adjustment sub-assembly, such as, for example, a plate 41 with rectangular holes 44 which can engage hooks 43 on forward section 42 to vary the vertical position of the crank set.

Figure 6:
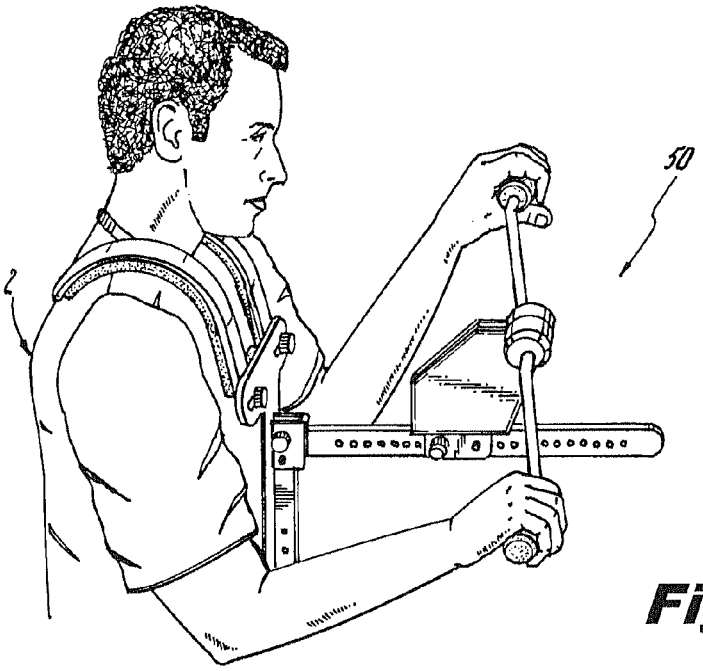
FIG. 6 is a side perspective view of the fourth embodiment of the invention in use by a person.

FIGS. 5 and 6 show the fourth embodiment 50 with a horizontal adjustment sub-assembly, including, for example, a harness utilizing bar 53 such as, for example, a series of holes 57. Bar 53 can engage bracket 52 mounted to harness chassis plate 51 in any of three vertical locations (at double holes) via double spring pins 54 located at the proximal end. Detachable modified forward section 55 with double spring pin plate 56 can engage any pair of adjacent holes 57. Therefore the horizontal position of the crank set can be varied in small increments while the vertical position can be set at three different levels. FIG. 6 shows a person 2 using harness 50.

Figure 7:
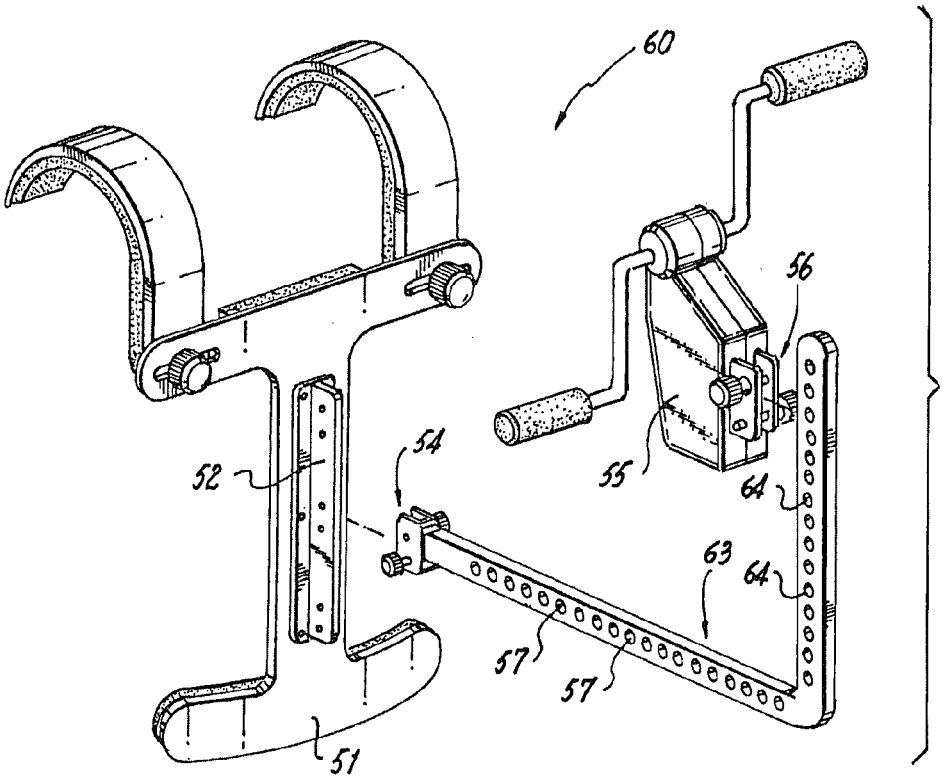
FIG. 7 is a perspective exploded view of the parts of the fifth embodiment of this invention using an L-shaped bar to offer placement variations of the crank set in both the horizontal and vertical directions in small increments.
Figure 8:
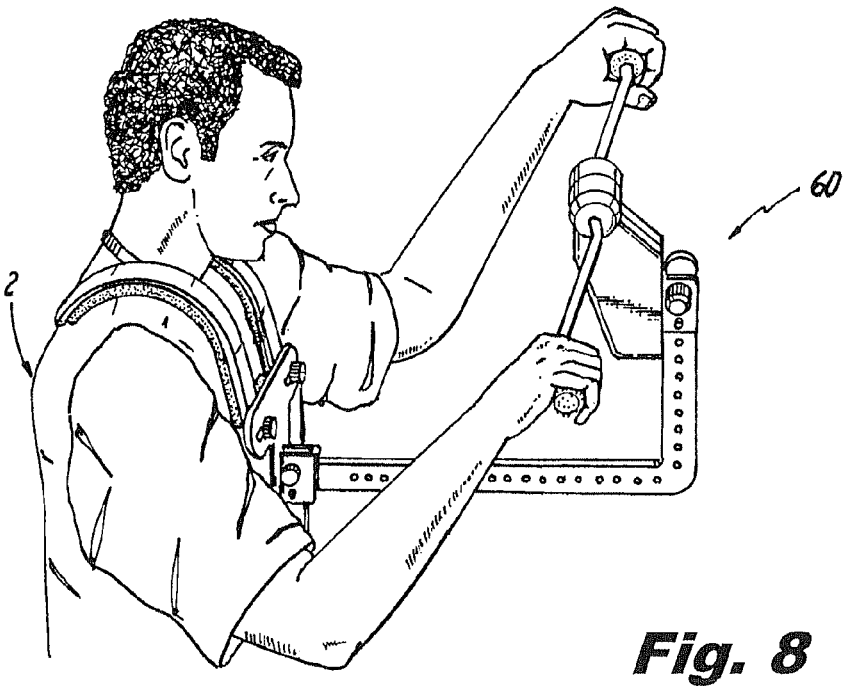
FIG. 8 is a side perspective view of the fifth embodiment of this invention in use by a person.

FIG. 7 shows the fifth embodiment 60 of upper body exercise harness with a further optional adjustment sub-assembly, such as, for example, which uses an L-shaped bar 63 with holes 57 along the horizontal section and holes 64 along the vertical portion. Forward section 55 can be positioned anywhere along either the horizontal section (holes 57) or the vertical section (holes 64) of L-shaped bar 63. If attached to the horizontal section it can be positioned in a manner similar to that of the forth embodiment as in FIG. 5. However, when attached to an adjacent pair of holes on the vertical section, the crank set can be adjusted in small increments vertically at the distal horizontal limit of bar 63. FIG. 8 shows person 2 using exercise harness 60.

FIG. 9 shows the sixth embodiment 70 of exercise harness of this invention. In this embodiment, quick smooth locating of the crank set in a forward region is achieved via harness chassis plate 71 with a locking telescopic sub-assembly, such as, for example, an attached ball joint 72 with locking collar 73 combined with ball connected telescoping rod 74 with lock knob 75.

FIG. 10 is a high level block diagram of the optional electronic monitoring system of this invention. Power source 81 in the form of a battery pack supplies power to controller 82 and wire-attached pedometer display 86, and heart rate monitor which is displayed at 83. Also displayed are timer 84 and calorie burning estimate display 85. Wires 87 and 88 to the person-attached sensors can be replaced by a Bluetooth wireless link. In fact, the entire electronic system can be replaced by a smart cell phone using downloadable application software (i.e.—an "app") with Bluetooth links. In that case, monitor screen 15 of FIGS. 1 and 2 would be replaced by a bracket to hold the smart phone in a screen-readable attitude.

FIGS. 11 to 13 show the modified crank set 90 of the optional seventh alternate embodiment of this invention for optional independent pedal resistance, wherein left crank 91 and right crank 92 are not connected by a single shaft. They each have their separate half-shafts 100 and 101 respectively as seen in FIG. 12. Adjusting knobs 98 and 99 are used to adjust the desired frictional load of the left crank and right crank respectively. Left housing 93 screws into right housing 94 via screw collar 95. Internal support disks 102 and 103 are attached to respective housing sections 93 and 94 via screws 96. Crank half-shafts 100 and 101 are supported by outer bearings 104 and internal bearings 105 and locked in place laterally by nuts 106. Each half-shaft has an attached brake drum 107 which is used to adjust the friction load independently. Brake pad blocks 108 with attached leaf spring 109 are forced against their respective brake drum via screws 110 through threaded holes in chassis sides with left and right external knobs 98 and 99 respectively. FIG. 13 is an end view detail showing the interaction among brake drum 107, brake pad block 108 leaf spring 109 and adjusting screw 110. Leaf spring 109 affords accurate friction loading as well as resistance to vibrational loosening.

It is further noted that crank 14 of the single full crank embodiment of FIGS. 1-3, or its positionally adjusted related embodiments shown in FIGS. 4-9, may have a similar resistance adjustment mechanism. The shaft has an attached brake drum which is also used to manually adjust friction load for the respective pedals with hand grips 20. Similar to the mechanism shown in FIG. 13, a brake pad block similar to brake pad blocks 108 with attached leaf spring 109 is forced against a brake drum similar to brake drum 107. It is further noted that either crank half shafts 100 and 101 of FIGS. 11-13 or a full crank 14 of FIGS. 1-3, or its positionally adjusted related embodiments shown in FIGS. 4-9, may also control resistance with a servo-control communicating with display window screen 15, whereby resistance is elevated up or down by incrementally pushing a button or touch screen button region up or down, such as for example, to raise or lower the resistance measured in increments of a defined wattage, such as 10 watts, for example, in either direction up or down to increase or decrease resistance of the rotating pedals.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A portable upper body exercise harness comprising:

a pair of loops adapted to be worn over shoulders of a user;

a harness chassis plate having a top portion attached to the loops and adapted to rest on the chest/abdomen of said user, free rearward ends of said loops being unattached thereby allowing said exercise harness to be readily mounted on and removed from said user;

a forward section member extending out from said chassis plate adjacent a chest/abdomen region of said user; and a crank set positioned on a distal end of said forward section member having crank arms adapted to be rotatably cycled by hands of said user for an upper body exercise while engaging in a lower body exercise.

2. The exercise harness of claim 1 having means for attaching said forward section to respective forward ends of said loops in which spacing of said loops from each other is adjustable to accommodate different size users.

3. The exercise harness of claim 2 in which said means for attaching comprises said chassis plate having a first pair of arms extending out opposite sides therefrom, slots in said arms, bolts attached to forward ends of said loops extending through said slots, respectively, and attachment knobs for engaging said bolts, thereby allowing said loops to be moved towards or apart from each other before tightening by said attachment knobs.

4. The exercise harness of claim 3 in which said first pair of arms extend out from an upper end of said chassis plate, said chassis plate having a second pair of arms extending out opposite sides thereof and from a bottom end thereof, said forward section member being located between said first and second pair of arms.

5. The exercise harness of claim 4 in which said second pair of arms are curved in such a manner as to partially embrace a curved abdomen of said user.

6. The exercise harness of claim 1 having means for detaching each of said crank arms, thereby allowing said user to use only one crank arm.

7. The exercise harness of claim 6 in which said means for detaching comprises a quick disconnect latch.

8. The exercise harness of claim 5 having means for adjusting a vertical position of said forward section member on said chassis plate.

9. The exercise harness of claim 8 in which said means for adjusting comprises a vertical array of spaced holes on said chassis member plate between said first and second pairs of arms, and a pair of hook members on a rear face of said forward section member adapted to engage any pair of spaced holes, whereby a user can readily adjust the height of said crank arms.

10. The exercise harness of claim 5 having means to adjust the distance of said crank arms away from said chassis member plate.

11. The exercise harness of claim 10 in which said means to adjust the distance comprises a bar member extending out forwardly from a front of said chassis plate, said bar member having a proximate end attached to said chassis plate, said bar member having spaced holes along a length thereof, and said forward section member having means on a bottom face thereof for engaging selected holes on said bar member, thereby placing said crank arms at a convenient distance for said user from said chassis plate.

12. The exercise harness of claim 11 having a bracket on said chassis plate allowing said bar member to be moved upwardly and downwardly thereon.

13. The exercise harness of claim 12 in which said bar member has an upwardly extension at a distal end thereof for allowing said forward section member to be positioned above said bar member at the distal end thereof.

14. The exercise harness of claim 1 in which said crank set comprises left and right cranks, each crank having independent shafts extending into a housing, and means for separately adjusting frictional load and resistance adjustment on each of said cranks.

15. The exercise harness of claim 14 in which each said means for adjusting frictional load comprises a brake drum and brake pad blocks with adjustable leaf springs for selecting desirable frictional loading and resistance adjustment on said cranks.

16. The exercise harness of claim 1 further comprising a means for adjusting frictional load and resistance adjustment on said crank set.

17. The exercise harness of claim 16 in which said means for adjusting frictional load and resistance adjustment comprises a brake drum and brake pad block with an adjustable leaf spring for selecting desirable frictional loading and resistance adjustment on said crank set.

18. The exercise harness as in claim 1 further comprising said forward section member having a screen visible to said user, said forward section member containing an electronic monitoring and information module for timing, tracking and computing body function data for display on said screen, and sensors adapted to be mounted on said user providing source information for said module.

19. The exercise harness as in claim 1 whexein said crank arms are horizontally adjustable toward or away from each other.

20. The exercise harness as in claim 1 wherein said forward section supporting said crank set is a telescoping rod extending from said chassis plate; and a proximal end of said telescoping rod is attached to said chassis plate using a ball joint thereby allowing said telescoping rod to be pivoted for the convenience of the user.

21. The exercise harness as in claim 1 wherein said harness chassis plate is supported by forward ends of said loops.

* * * * *